United States Patent [19]

Rovinsky et al.

[11] Patent Number: 4,869,080

[45] Date of Patent: Sep. 26, 1989

[54] LINT-REMOVING FLUTTER TUBE FOR A KNITTING MACHINE

[76] Inventors: William Rovinsky, 212 Haypath Rd., Old Bethpage, N.Y. 11804; Steven Meszaros, 66-17 Main St., Flushing, N.Y. 11367

[21] Appl. No.: 225,923

[22] Filed: Jul. 29, 1988

[51] Int. Cl.[4] ..... D04B 35/32

[52] U.S. Cl. ..... 66/168; 15/316 R

[58] Field of Search ..... 15/316 R; 57/301; 66/168

[56] References Cited

U.S. PATENT DOCUMENTS 4,691,536 9/1987 Yorisue et al. ..... 66/168

FOREIGN PATENT DOCUMENTS 61-161332 7/1986 Japan ..... 15/316 R

*Primary Examiner*—Wm. Carter Reynolds

[57] ABSTRACT

A knitting machine attachment using pressure air flow through, and discharging from, plural flutter tubes to control the accumulation of lint. Each individual tube construction consists of an inner circular bore and an encircling eliptical wall which causes a flutter or pivotal traverse in a specified plane or path, namely that in favor of the weaker or thinner walls of the tube. This maximizes the amount of discharging pressure air that can be directed against specific locations where lint is likely to accummulate.

4 Claims, 1 Drawing Sheet

LINT-REMOVING FLUTTER TUBE FOR A KNITTING MACHINE

The present invention relates generally to an attachment for a knitting machine for obviating the accumulation of lint, dust or the like, at critical locations and on critical components of the knitting machine, such as at the knitting stations where the sinkers, knitting needles, yarn feeding and other devices are located.

A popular, and already widely used lint-control devie, is of the type using pressure air and the phenomenon which results when this pressure air and the phenomenon which causing a flutter in the end of tube which directs the discharging air over a target area. The prior art flutter tubes are thus advantageously mounted in clearance positions from locations where lint is known to accumulate, and are expected to blow away, or otherwise prevent, the accumulation of lint.

EXAMPLES OF PRIOR ART

U.S. Pat. No. 4,691,536 issued on Sept. 8, 1987 to Yorisue et al. shows as part of a lint-removal system for a knitting machine, the use of a flexible, and thus fluttering, nozzle or tube 34, for directing pressure air at a location requiring the lint removal. To control the path of the flutter or swing, the tube 34 is confined within an outer or encircling tubular constraint 36, without which it would flutter randomly and thus not always so as to direct pressure air at the target location.

U.S. Pat. No. 3,897,605 issued earlier on Aug. 5, 1975 to Dickinson is noted even though not directed to a knitting machine lint control, because of the disclosure therein also of a flexible tube 42, and more particularly one having a fluttering or whipping action as caused by pressure air flowing and discharging through the tube, for removing lint-like material from a target area at which the tube is directed. The changing directions of the flutters or pivotal traverses are not controlled and occur randomly, but wear at the end of the tube is minimized by the formation at this location of a plastic nub.

In the above noted, and all other known prior art flutter tubes, the flutter caused by the pressure air is, of course, desirable because it provides an increased sweep or target area for the discharge. However, unless some control is exercised thereover, the fluttering occurs randomly and thus a significant amount of the discharged air may not be directed towards locations where it can be useful for the purposes intended. The control in the prior art consists primarily of external constraints imposed on the flutter tube, which confines its movement only along certain directions and paths.

While effective, these external constraints add to the expense, installation and operation of the lint control system. In contrast, the within inventive lint-controlling flutter tube is able to be accurately directed towards specific target areas, and during lint-control service maintains its operative relation thereto, solely as a result of its construction which, moreover, is consistent with its current economic manufacture initially as an elastomeric extrusion in the form of an elongated tube and afterwards appropriately cut to the size needed.

The description of the invention which follows, together with the accompanying drawings should not be construed as limiting the invention to the example shown and described, because those skilled in the art to which this invention appertains will be able to device other forms thereof within the ambit of the appended claims.

Figure 1:
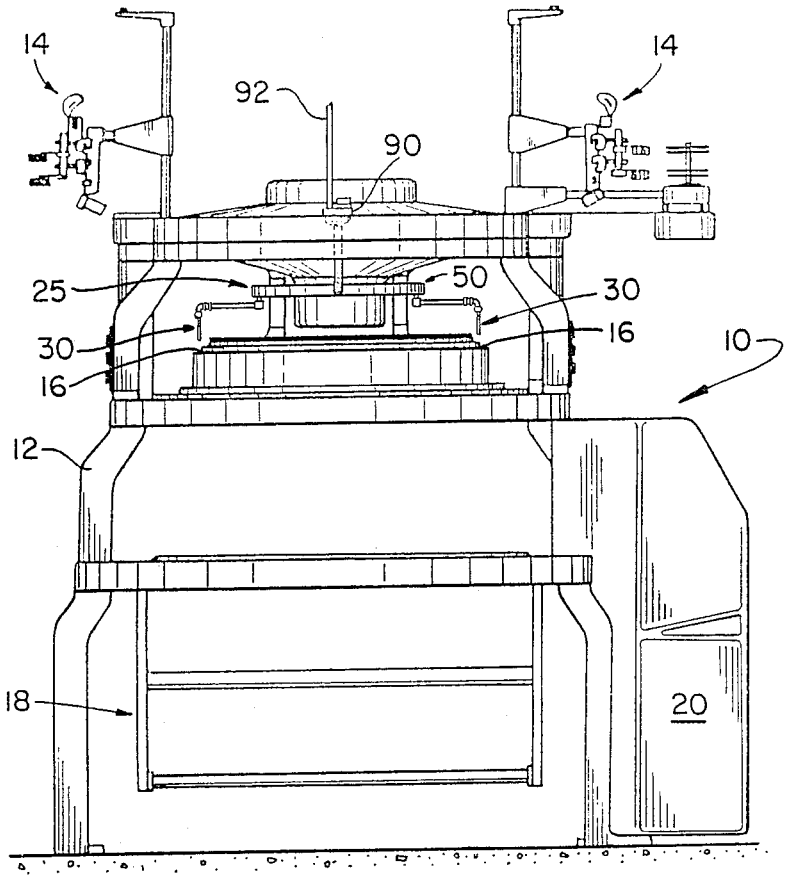
FIG. 1 is an overall elevational view of a knitting machine using the within inventive flutter tubes for lint control.

In FIG. 1 is shown, somewhat schematically, an overall view of a knitting machine 10 and, in particular, a machine of the double knit type. Mounted on chassis frame 12 in "downstream" sequence is a yarn feed section 14, an array of knitting stations 16, and a lower section having a take-up roller mechanism 18 therein. Suitable controls and drive mechanisms are contained within cabinet section 20.

A problem of particular concern to the knitting industry is the accumulation of lint along the feed path of yarn used for knitting; i.e. the path from the spools of knitting yarn to the knitting needles at the stations 16. Accumulation of lint sometimes results during the knitting of the yarn into the fabric of lint slubs in the fabric, thereby reducing the quality of the fabric. To correct this problem, various means of lint removal have been employed. Of particular interest in this case is an air delivery system 25 to blow away lint accumulation in the vicinity of the plural kitting stations 16. Air delivery system 25 consists of an array of flutter tubes 30, a tubing chase 50 for mounting the tubes 30, an air sequencer 90, and a remote compressed air supply 92.

Except for the flutter tubes 30, subsequently to be described in detail herein, the other noted components of the air delivery system 25 are to be understood to be already well known, being illustrated and described for example in the previously identified prior art patents, which illustrations and descriptions are incorporated herein by reference. Further description of these components will therefor be omitted as necessary.

Also, to minimize drawing confusion in FIG. 1, only two of each of the flutter tubes 30 and yarn feed positions 14 are shown, it being understood that the other tubes and stations are similarly constructed, and that suitable numbers of each are provided depending upon the model of the knitting machine involved.

The use of compressed air to blow away lint accumulation along the yarn path is also already well known, as is the use of flexible tubing at the air discharge point, all as was previously noted in the previously referenced prior patents. Basic to the use of flexible tubing at the use point, is the phenomenon of the "action and reaction" which takes place at the free end of any flexible tubing as a result of a fluid jet passing through and discharging from the tubing. This phenomenon results in the random swinging of the tube tip as discharge takes place. When it is desired to sweep away lint along a linear path, i.e. a path that is parallel to a knitting needle, the random motion of the tube tip results in a large percentage of discharged air being ineffective. The prior art effort to obviate this shortcoming has made use of tube restraints and guide members to more accurately direct the discharged air along the desired path. In all instances, however, the flexible tubing was made symmetrical and with a uniform wall about its linear axis, and this has necessitated the use of restraints and guide members, with their attendant expense for manufacture, installation and handling.

Figure 4:
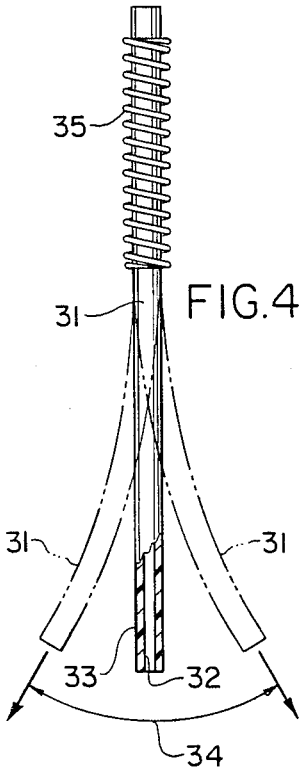
FIG. 4 is a side elevational view projected from FIG. 2, showing the "narrow" side of the flutter tube.
Figure 6:
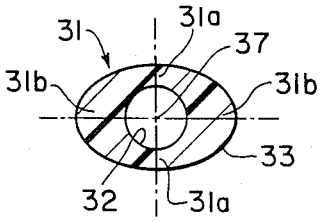
FIG. 6 is an isolated sectional view of the flutter tube, as taken along line 6—6 FIG. 5, showing the inventive features thereof.

In contrast to the prior art, and specifically without using any restraints, guide members or the like, but primarily only by the construction of the flexible or flutter tube 30, there has been achieved noteworthy control over the target or directed area of the compressed air discharge therefrom. To this end, the present invention contemplates the use of a particular flexible tubing 31 which is characterized by the cross section as detailed in FIG. 6, wherein the bore 32 is circular and an outside wall 33 bounding this bore is in an eliptical shape, about a common center 37. It has been found that when high pressure fluid discharges from the unsupported end of a flexible tubing constructed as shown in cross section in FIG. 6, that the end thereof will swing or flutter in a direction parallel to the long axis of the eliptical outside wall 33 or in the path of the pivotal traverse 34 of FIG. 4. This is, flutter will take place in favor of the weaker or thinner walls 31a and inherently be restrained in the direction of the stronger or thicker walls 31b.

In practice it has been found that the amplitude of the flutter swing 34 (see FIG. 4), and volume of air discharge, are influenced by the fluid pressure within the bore 32, as well as by the dimensions of the inner and outer shapes 32 and 33, and by the construction material of the tubing 31 and the length of the free end of this tubing. For any selected length in the flutter swing 34, it is therefor necessary on a trial and error basis to modify the parameters noted. However, the basic FIG. 6 cross section in the flutter tube 31 will, by itself, and without any constraints or the like, provide the directional pivotal traverse 34 of FIG. 4.

Although shown in use in FIG. 1 at the knitting position 16, it will be understood that a flutter tube 30 can be used anywhere along the yarn path to eliminate the bothersome accumulation of lint.

For completeness sake, the preferred manner of mounting the individual tubes 31 so as not to impede the pivotal traverse 34 thereof will now be described, although it will be understood that other mounting techniques may be employed.

Figure 2:
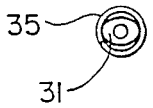
FIG. 2 is an isolated view of one of the flutter tubes.
Figure 3:
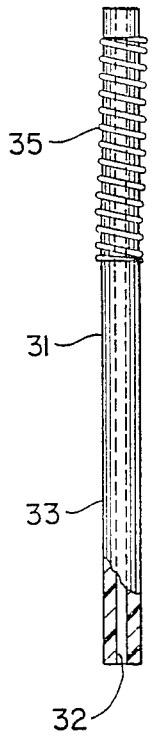
FIG. 3 is s front elevational view projected from FIG. 2, showing the "broad" side of the flutter tube.
Figure 5:
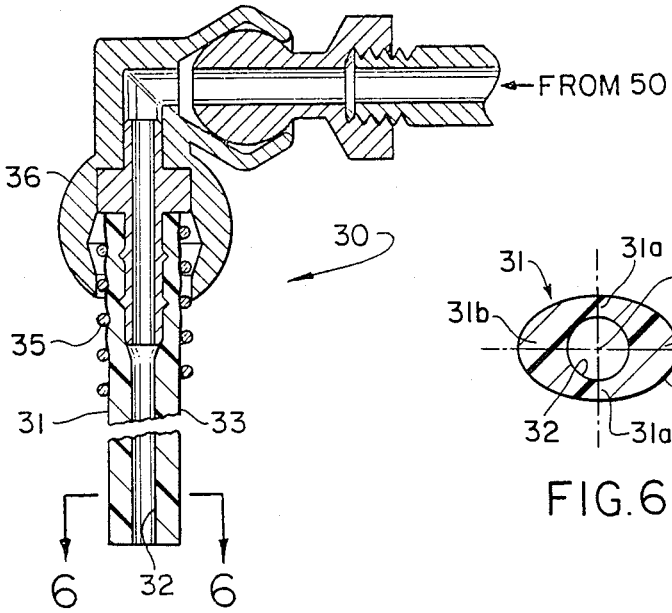
FIG. 5 is an isolated sectional view of the flutter tube, showing its supported connection to a pressure air source.

As best shown in FIG. 5, tubing 31 is inserted within a spring-like member 35. Spring 35, with flattened and ground ends, is made to have a slight interference (FIG. 2) with the long axis of surface 33 to help grasp and support tubing 31 within a cooperating fitting 36. Spring 35 and tubing 31 can be secured within fitting 36 by clamping, cementing, force fitting or otherwise to provide for the free passage of compressed air from chase 50. The size of wire, spring pitch and overall length of spring 35 can be varied to influence limited restraint on the free length of tubing 31, but again, the FIG. 6 construction of the tube provides by itself, the path of the swing. Fitting 36 is preferably of the friction swivel type for ease of locating and maintaining the linear path of the air leaving flutter tube 31 during use. Axial orientation of tubing 31 within fitting 36 along with an appropriate consideration of the previously noted factors that determine the degree of the amplitude 34 and the direction thereof afford the user an accurate and efficient sweep of a lint accumulation area on knitting machine 10.

While the particular lint-removing flutter tube herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In the lint removing device for a circular knitting machine formed as a flexible elastomeric tube of the type wherein pressure air is flowed through and discharges from the tube to control the accumulation of lint, the improvement comprising a circular bore extending axially of said tube for the passage through and discharge of pressure air therefrom, and an elliptically shaped wall in encircling relation about and bounding said circular bore to provide a first pair of opposing wall sections of comparative narrow extent coincident with the short axis of said elliptical shape and a second pair of opposing wall sections of comparative thick extent coincident with the long axis of said eliptical shape, whereby the discharging pressure air causes a pivotal traverse in an end of said tube which is restricted to a plane permitted by said narrow walls and inhibited from occurring in a traverse plane by said thick walls.

2. A plurality of said lint-removing tubes as claimed in claim 1 having an operative position arranged in facing relation to circular yarn knitting components of said knitting machine, wherein each said tube is arranged with each said narrow walls thereof so as to cause a pivotal traverse in the end thereof which is tangential to said circular yarn knitting components, whereby said pivotal traverses cooperate to direct the pressure air discharge entirely over said circular yarn knitting components.

3. In a lint removing device for a circular knitting machine formed as a flexible elastomeric tube wherein pressure air is flowed through and discharges from the tube to control the accumulation of lint, the improvement comprising a bore of a first selected shape extending axially of said tube for the passage through and discharge of pressure air therefrom, and a wall of a selected second shape in encircling relation about and bounding said bore to provide as a result of the differences in said first and second shapes in a first apir of opposing wall sections of comparative narrow extent and a second pair of opposing wall sections of comparative thick extent, whereby the discharging pressure air causes a pivotal traverse in an end of said tube which is restricted to a plane permitted by said narrow walls and inhibited from occurring in a traverse plane by said thick walls.

4. A plurality of said lint-removing tubes as claimed in claim 3 having an operative position arranged in facing relation to circular yarn knitting components of said knitting machine, wherein each said tube is arranged ith each said narrow walls thereof so as to cause a pivotal traverse in the end thereof which is tangential to said circular yarn knitting components, whereby said pivotal traverses cooperate to direct the pressure air discharge entirely over said circular yarn knitting components.

* * * * *